United States Patent [19]

Taylor

[11] 3,997,358

[45] Dec. 14, 1976

[54] CLEANING PROCESS FOR SEMICONDUCTOR DIE

[75] Inventor: Myron Lewis Taylor, Phoenix, Ariz.

[73] Assignee: Motorola, Inc., Chicago, Ill.

[22] Filed: Feb. 19, 1976

[21] Appl. No.: 659,304

[52] U.S. Cl. ..... 134/7; 51/313; 134/25 R; 134/33

[51] Int. Cl.[2] ..... B08B 7/00

[58] Field of Search ..... 134/7, 25 R, 33; 51/313, 164

[56] References Cited

UNITED STATES PATENTS

| | | | |
|---|---|---|---|
| 458,571 | 9/1891 | Gedge | 51/164 |
| 631,133 | 8/1899 | Starke | 51/313 X |
| 1,678,359 | 7/1928 | Schulte | 134/7 X |
| 2,387,141 | 10/1945 | Fruth | 51/313 X |
| 2,425,984 | 8/1947 | Blackman | 134/7 |
| 2,851,829 | 9/1958 | Martin | 134/7 X |

*Primary Examiner*—S. Leon Bashore
*Assistant Examiner*—Richard V. Fisher
*Attorney, Agent, or Firm*—Robert A. Farley; Harry M. Weiss

[57] ABSTRACT

A method for removing slag and debris from the surfaces of laser scribed semiconductor die is provided in which the die and glass or metal beads are placed into a cylindrical wire mesh basket and the basket is turned causing the beads and die to mechanically mix. The mechanical mixing action removes debris and slag which subsequently falls through the wire mesh of the basket so that the die surfaces are not marred.

4 Claims, No Drawings

CLEANING PROCESS FOR SEMICONDUCTOR DIE

BACKGROUND

This invention pertains in general to processes for manufacturing semiconductor devices and in particular to a process for cleaning the surfaces of laser scribed semiconductor die.

A fundamental operation in the manufacture of semiconductor devices is the procedure by which the semiconductor units which have been batch fabricated on a semiconductor wafer are separated into individual, separate units commonly referred to as chips or die. Traditionally this separation was performed by scribing the surface of the semiconductor wafer to form a rectangular grid such that each rectangle delineated the periphery of a particular semiconductor unit. Application of mechanical pressure to the surface of the wafer caused fracturing along the scribed lines to accomplish the separation into individual semiconductor units or die. One problem inherent in a "scribe and break" operation of this type is the tendency for a semiconductor wafer to fracture along the natural cleavage planes associated with its crystal structure. This sometimes caused fracturing which did not correspond to the scribe rectangular grid such that some die were ruined. A recent improvement which alleviated this problem was the adoption of laser "scribing" in which a laser beam is used to melt narrow channels into the surface of the semiconductor wafer corresponding to the rectangular grid defining the periphery of the semiconductor die. The energy of the laser beam can be adjusted to form a channel which is relatively deep such that the resulting breaking operation will correspond to the rectangular grid rather than to crystal cleavage plains. Although the use of laser scribing offers definite advantages over diamond scribing, it introduces a new problem. This problem arises because relatively large volumes of oxide and silicon are melted by the laser beam as it cuts a channel along the scribe grid and this molten material is spewed out on either side of the channel as slag and debris. Secondary melting causes the slag to adhere firmly to the surface of the semiconductor die making it difficult to remove. The presence of laser slag on the surfaces of the semiconductor die can interfere mechanically to affect the yield of subsequent bonding steps in the assembly of the semiconductor die into a completed semiconductor device. The slag can also interfere electrically to form shorts and leakage paths which affect the electrical quality of the completed semiconductor device.

SUMMARY OF THE INVENTION

Accordingly, it is an object of this invention to provide an improved process for cleaning semiconductor die.

It is a further object of this invention to provide an improved process for removing slag and debris from the surfaces of laser scribed semiconductor die.

Briefly described, the invention is a process for removing slag and debris from the surfaces of laser scribed semiconductor die in which the die and glass or metal beads (cleaning aggregate) are placed in the cylindrical wire mesh basket and the basket is rotated causing the the beads and die to mechanically mix whereby the surfaces of the die are cleaned of debris and slag which then falls through the wire mesh of the basket.

DETAILED DESCRIPTION OF THE INVENTION

In more detail, the method of the present invention comprises a process for tumbling laser scribed semiconductor die with glass beads which has proven effective for removing laser slag and debris from a wide variety of different types of die of different sizes. In one embodiment of the invention, the process is used to remove slag from laser scribed zener diode die which are approximately 20 mils square. The die are batch fabricated in wafer form on silicon wafers which are two inches in diameter and are from 7–9 mils thick. In scribing these wafers, the laser beam cuts a groove or kerf approximately 2 mils wide and 2–4 mils deep. This results in a pile-up of laser slag and debris of up to 0.4 mils in height at the edges of the kerf and a scattering of molten droplets of oxide and silicon over the surface of the die. Because the slag and droplets are formed in the molten state they adhere tenatiously to the die surfaces, apparently due to the secondary melting and cannot be effectively removed by the normal die operations used to remove chips and loose particles such as washing in ultrasonically agitated distilled water. The heart of the invention resides in the discovery that the firmly adhering laser slag could be completely and efficiently removed without damaging or marring the die surfaces by tumbling the die with glass beads for a short period of time. The invention is a departure from conventional tumbling operations in which objects are tumbled for a long period of time to grind and polish surfaces. Another fundamental aspect of the invention resides in the use of a wire mesh cylinder in which the openings in the wire mesh are sized so as to retain the die and beads inside the cylinder while allowing the removed particles of slag and debris to fall away through the wire mesh of the cylinder. The irregularly shaped and abrasive pieces of slag and debris are thus separated from the die and beads as they mix and tumble together and are therefore prevented from scratching or marring the surfaces of the die.

In one particular embodiment of the invention, approximately 6,000 die approximately 20 mils square and from 100–200 glass beads which are generally spherical and are approximately 0.110 inches in diameter are placed in a cylindrical wire mesh basket. The wire mesh basket is from 1½ to 2 inches in diameter and approximately 4 inches in length and has a mesh opening size of approximately 10 mils. The wire mesh basket is closed and placed on a set of rotating rollers such that the basket is rotated causing the die and glass beads to tumble together. The basket is rotated at a speed of approximately 30 revolutions per minute for from 8–15 minutes which is found to be sufficient to completely dislodge the adhering laser slag from all die surfaces. The die are then washed in ultrasonically agitated distilled water, rinsed in alcohol and freon and dried for a short time in an infrared oven at which time they are ready for subsequent bonding steps required for the manufacture of the completed semiconductor device. An incidental benefit of the method of the present invention is that these wash and rinse steps can be performed with the semiconductor die still retained in the cylindrical wire mesh basket.

The method of the present invention has proven highly effective in removing laser slag from a wide variety of die. For a particular version of the invention described above, the 20 mil square zener diode die were coated with metal on both the front and back surfaces. As a result of the present invention, the smooth edges on the die and the clean surfaces of front and back metal provide excellent areas on which to bond device slugs providing a more reliable device. Analysis of production lots processed according to the invention showed an increase in usable die yield from about 19% to about 60%. In addition to mechanical effects the electrical quality of die processed according to the invention is improved. For the particular case of zener diode devices manufactured according to the method of the present invention, electrical analysis of production lots showed consistently lower percent rejects for electrical test perimeters such as forward diode voltage, reverse current leakage and reverse bias impedance. Electrical analysis indicates that these improved results are obtained because the laser slag and debris on the surface of the semiconductor die create minute conductive paths which alter electrical parameter values. The complete removal of the slag eliminates these paths and therefore results in improved electrical operation.

In another version of the invention the process described above was used substituting spherical steel beads of approximately .100 inches in diameter for the glass beads. Visual analysis of production lots processed with this version of the invention indicate that the steel beads are equally as effective in removing laser slag and debris as are the glass beads and that similar improved assembly yields and electrical test yields are obtained. The process of the present invention has been implemented on a variety of semiconductor device production lines including those where the semiconductor die are coated with metal front and back and those in which the semiconductor die are completely coated with metal on the back and are coated with passivation glass which has openings there through to expose bonding islands on the front and are as large as 150 mils square. Analysis of production lots indicates effective laser slag removal and the resulting yield improvements as described above on all of these production lines. These results indicate that the process of the present invention provides a highly effective and efficient method for removing laser slag and debris from the surfaces of the laser scribed semiconductor die such that assembly bonding yields and electrical test yields as significantly increased when the invention is practiced in accordance with the description given above.

What is claimed is:

1. A method for removing slag and scribing debris from the surfaces of laser scribed semiconductor die comprising the steps of:

a. placing said die and a cleaning aggregate together in a cylindrical wire mesh container of 1½ to 2 inch diameter; and b. tumbling said die and said cleaning aggregate together by rotating said container at 30 revolutions per minute for from 8 minutes to 15 minutes to remove the slag and scribing debris from the die, the wire mesh being sized so as to retain the die and aggregate inside the cylinder, while allowing the removed slag and scribing debris to fall through the wire mesh of the cylinder.

2. The method recited in claim 1 wherein said cleaning aggregate comprises metal beads.

3. The method recited in claim 1 wherein said cleaning aggregate comprises glass beads.

4. The method recited in claim 3 wherein said glass beads are spherical and have a diameter of 0.110 inches.

* * * * *